US007619583B2

(12) United States Patent
Ludwick

(10) Patent No.: US 7,619,583 B2
(45) Date of Patent: Nov. 17, 2009

(54) ANTENNA TILTPLATE

(75) Inventor: Clifford Alvin Ludwick, 2991 Johnson Rd., Loganville, GA (US) 30052

(73) Assignee: Clifford Alvin Ludwick, Loganville, GA (US)

( * ) Notice: Subject to any disclaimer, the term of this patent is extended or adjusted under 35 U.S.C. 154(b) by 0 days.

(21) Appl. No.: 12/014,818

(22) Filed: Jan. 16, 2008

(65) Prior Publication Data

US 2009/0179821 A1 Jul. 16, 2009

(51) Int. Cl.
*H01Q 3/02* (2006.01)

(52) U.S. Cl. ..... 343/882; 343/880

(58) Field of Classification Search ..... 343/882, 343/878, 880

See application file for complete search history.

(56) References Cited

U.S. PATENT DOCUMENTS 2,972,891 A * 2/1961 Elliott ..... 74/1 R
3,011,586 A * 12/1961 Harvey, Jr. ..... 182/115
5,075,682 A * 12/1991 Dehnert ..... 342/352
6,342,870 B1 * 1/2002 Mehrkens et al. ..... 343/891

* cited by examiner

*Primary Examiner*—James Cho

(57) ABSTRACT

Maintenance on an amateur radio antenna mounted on a tilt over tower typically requires the use of a ladder of scaffold. While tiltover towers are common, when used with a large yagi antenna they tilting is limited by the length of the antenna boom and elements. The user must still utilize a ladder or scaffold to reach all point on the antenna. The tiltplate address this issue and allow the tower and antenna to be tilted all the way to ground level.

3 Claims, 1 Drawing Sheet

Drawings --- Figure 1
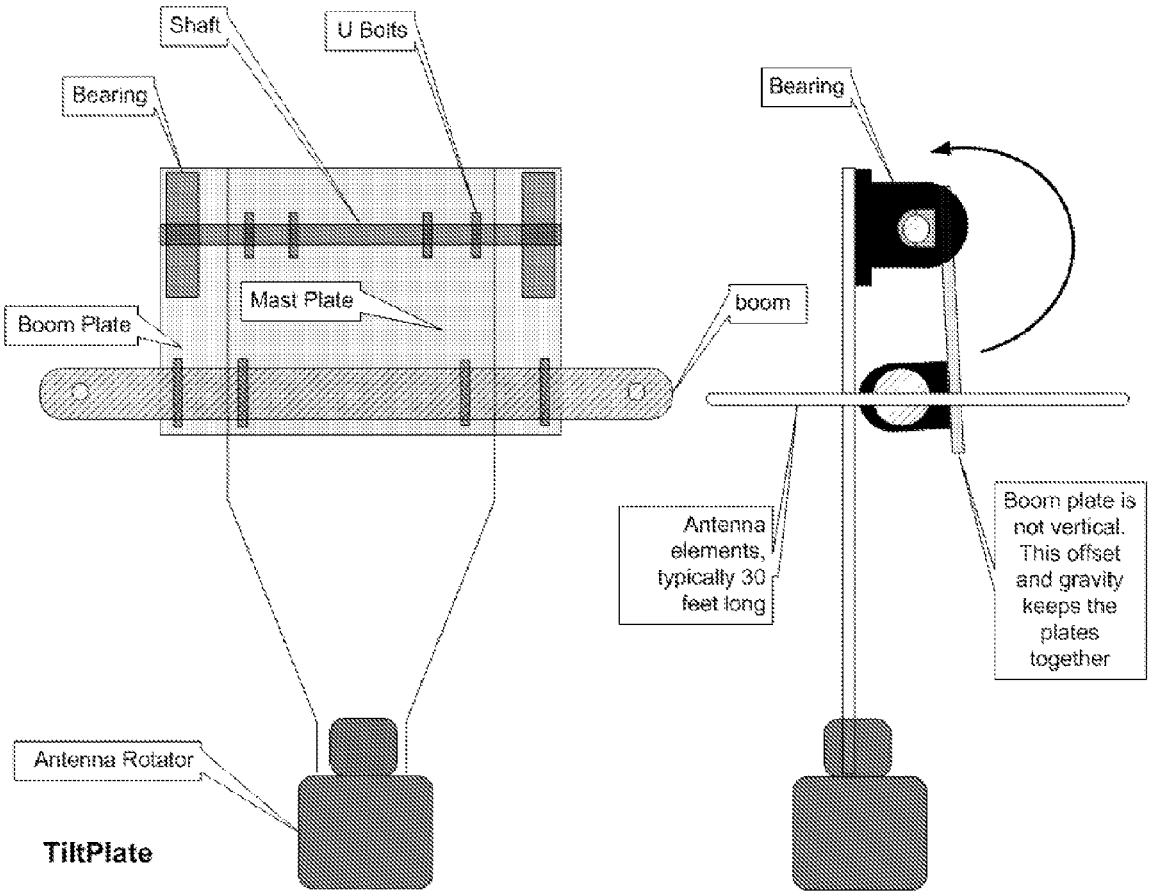

ANTENNA TILTPLATE

CROSS-REFERENCE TO RELATED APPLICATIONS

"Not Applicable"

STATEMENT REGARDING FEDERALLY SPONSORED RESEARCH OR DEVELOPMENT

"Not Applicable"

REFERENCE TO SEQUENCE LISTING, A TABLE, OR A COMPUTER PROGRAM LISTING COMPACT DISC APPENDIX

"Not Applicable"

BACKGROUND OF THE INVENTION

Yagi type Amateur Radio antennas are typically mounted on radio towers. These towers may be of the tilt over type which is intended to facilitate maintenance on the ground or near to the ground. Large Yagi antennas may prevent tilting the tower to ground level due to the length of the antenna boom and elements requiring the use of ladders or scaffolds to reach all points on the antenna. A simple mechanism to facilitate this tilting function and allow antenna maintenance without climbing is not available.

BRIEF SUMMARY OF THE INVENTION

The TiltPlate will allow an antenna to rotate such that the elements become parallel to the tower as it is tilted over. This allows the antenna to be lowered until it is at ground level for maintenance. The tilting mechanism must also maintain the antenna in the normal operating position when the tower is vertical. A mechanism to insure the proper position needs to be controlled without requiring the user to climb the tower. The mechanism must also function properly in windy conditions. The use of this invention is not limited to amateur radio antennas but can be applied to any beam or yagi type antenna.

BRIEF DESCRIPTION OF THE SEVERAL VIEWS OF THE DRAWING

FIG. 1 describes the TiltPlate which is comprised of 2 aluminum plates. On one plate is located a pair of pillow block bearings. The other plate is attached by a shaft. The main rotor plate is attached to the tower mast. The antenna is attached to the movable plate. The antenna is held in place with the tower is vertical by gravity. The antenna swings parallel to the tower as it is tilted also by gravity.

DETAILED DESCRIPTION OF THE INVENTION

The tiltplate is made of aluminum plates of sufficient size to withstand the forces of wind while keeping the weight to a minimum. The mechanism must also be strong enough to withstand the torsional forces of turning and stopping the antenna. On one plate is located a pair of pillow block bearings. The other plate is attached by a shaft. The main rotor plate is attached to the tower mast. The antenna is attached to the movable plate. The antenna is held in place with the tower is vertical by gravity. The antenna swings parallel to the tower as it is tilted also by gravity.

The tilting force and the force to keep the antenna is gravity due to the lever arm form by the bearings and shaft. This eliminates the need to provide a manual locking mechanism. It also eliminates the need to use ladders or scaffolds to access the tilting mechanism.

Other solutions to this maintenance problem utilize trams or pulley systems to lower the antenna to the ground. Ladders and scaffolds are often still needed with these solutions.

The invention claimed is:

1. A tiltplate providing a unique mechanism for a yagi antenna tower comprising a first plate for attaching to an antenna mast;

a movable plate for attaching to an antenna element;

a pair of pillow block bearings attached to the first plate; and a shaft for attaching the movable plate to the bearings wherein a lever arm formed by the bearings and shaft creates a gravity force such that the tiltplate enables the antenna element to be lowered all the way to ground level.

2. The tiltplate according to claim 1, where the tiltplate provides a mechanism that orients the yagi antenna element parallel to the yagi antenna tower as the tower is tilted to ground level.

3. A tiltplate providing a unique mechanism for a yagi antenna tower comprising a gravity powered lock;

a mast plate for attaching to an antenna mast or a rotor plate of the yagi antenna tower;

a moveable plate for attaching to an antenna element;

a pair of pillow block bearings attached to the mast plate; and a shaft for attaching the movable plate to the bearings;

wherein the gravity powered lock comprising of a pivot block, a catch rod, and a catch plate wherein the pivot block is attached to the moveable tiltplate, and the catch rod is shaped to catch a catch bolt mounted on the catch plate which provides pull tight when the moveable plate lifts due to high wind, and in the normal operational position the catch rod swings freely about ¼ inch below the catch bolt so that when the tower is tilted over for maintenance the catch rod pivots clear of the catch bolt well in advance of any movement or separation of the tiltplates.

* * * * *